US007534125B1

(12) United States Patent
Schroll

(10) Patent No.: US 7,534,125 B1
(45) Date of Patent: May 19, 2009

(54) ELECTRICAL CONNECTOR HAVING A MULTI-DIRECTIONAL LATCHING MECHANISM

(75) Inventor: Neil Franklin Schroll, Mount Joy, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 12/037,469

(22) Filed: Feb. 26, 2008

(51) Int. Cl.
*H01R 13/62* (2006.01)

(52) U.S. Cl. ..... 439/352; 439/157

(58) Field of Classification Search ..... 439/352, 439/157

See application file for complete search history.

(56) References Cited

U.S. PATENT DOCUMENTS 5,330,366 A * 7/1994 Tsuji et al. ..... 439/352
5,564,939 A 10/1996 Maitani et al.
6,371,787 B1 4/2002 Branch et al.
6,589,066 B1 7/2003 Wu
6,702,603 B2 3/2004 Wu
6,881,095 B2 4/2005 Murr et al.
6,887,091 B1 5/2005 Wu
6,966,790 B2 * 11/2005 Roese ..... 439/353
7,147,502 B1 12/2006 Wu
7,160,135 B1 1/2007 Wu
7,207,823 B1 4/2007 Yang
7,238,040 B1 7/2007 Wu
7,281,937 B2 10/2007 Reed et al.
7,281,938 B1 10/2007 Wu
7,309,250 B2 12/2007 Reed et al.
7,318,740 B1 1/2008 Henry et al.
7,322,845 B2 1/2008 Regnier et al.
7,354,292 B1 4/2008 Lloyd et al.
2004/0023546 A1 2/2004 Wu
2006/0189197 A1 8/2006 Reed et al.
2007/0243749 A1 10/2007 Wu

* cited by examiner

*Primary Examiner*—Truc T Nguyen

(57) ABSTRACT

A latching assembly includes a latch and an actuator. The latch includes a latching end configured to latch with a receptacle assembly. The actuator is movable in both a push direction and a pull direction. The actuator raises the latching end to unlatch from the receptacle assembly when the actuator is pushed in the push direction and when the actuator is pulled in the pull direction.

20 Claims, 9 Drawing Sheets

ELECTRICAL CONNECTOR HAVING A MULTI-DIRECTIONAL LATCHING MECHANISM

BACKGROUND OF THE INVENTION

The subject matter herein generally relates to electrical connectors and, more particularly, to an electrical connector having a latching mechanism for securing the electrical connector to a mating connector.

Various types of latches have been proposed for electrical connectors such as external mini-SAS connectors. The electrical connectors are inserted into corresponding receptacles to communicate data. Existing connectors include a mating end that is plugged into the receptacle. A corresponding latching assembly for the connector latchingly engages with the receptacle to securely hold the mating end of the connector in the receptacle. The latching assembly latches with the receptacle by raising hooks proximate the mating end of the connector, inserting the mating end into the receptacle, and then lowering the hooks to latch with holes in the receptacle. The connector is then securely engaged with the receptacle. In order to unlatch the latching assembly from the receptacle, the hooks are raised out of the holes in the receptacle. The mating end of the connector is then removed from the receptacle.

Existing latching assemblies are configured to raise and lower the hooks of the latching assemblies, relative to the receptacles, by actuating a tab or other handle on a latching assembly. The hooks in some latching assemblies are raised when the handle is pushed (referred to as "push-only latching assemblies").

The hooks in other latching assemblies are raised when the handle is pulled (referred to as "pull-only latching assemblies"). As a result, a user of the latching assemblies cannot switch between pushing and pulling the handles of the latching assemblies to unlatch the hooks.

The inability of existing latching assemblies to permit latching and unlatching of the assemblies with corresponding receptacles by only pushing or pulling the handle of a latching assembly (but not both or in any other direction) can make it difficult to use the latching assemblies in certain spaces. For example, the location of certain receptacles can make grasping and pulling the handle of a latching assembly to latch the latching assembly with the receptacle very difficult. The opposite situation may also be true—certain locations of a receptacle can make it difficult to push a handle of a latching assembly to latch or unlatch the latching assembly with the receptacle. In these situations, only one of the push-type or pull-type latching assemblies may be used and the other type of latching assembly may be too difficult to use. In other situations, it can be difficult to push or pull a handle of a latching assembly to latch or unlatch the latching assembly with the receptacle. As a result, many latching assemblies become too difficult to use in certain spaces.

Moreover, many latching assemblies provide mechanisms for latching with the receptacle once the handle of the latching assembly is released. Yet, these latching assemblies frequently include additional parts and components in order to latch the latching assembly with the receptacle. These additional parts and components add to the cost and complexity of the latching assemblies.

Thus, a need exists for a latching assembly for an electrical connector that provides the option of unlatching the latching assembly from a receptacle by multiple moving actions, including pushing or pulling a handle or tab along a longitudinal direction of the latching assembly, or moving the handle or tab downwards with respect to the latching assembly.

BRIEF DESCRIPTION OF THE INVENTION

In one embodiment, a latching assembly for an electrical connector is provided. The latching assembly includes a latch and an actuator. The latch includes a latching end configured to latch with a receptacle assembly. The actuator is movable in both a push direction and a pull direction. The actuator raises the latching end to unlatch the latching end from the receptacle assembly when the actuator is pushed in the push direction and when the actuator is pulled in the pull direction.

Optionally, the latch includes a pair of oppositely sloped ramps. The actuator slides along a first one of the ramps to raise the latching end and unlatch the latching end from the receptacle assembly when the actuator is pushed in the push direction. The actuator slides along a second one of the ramps to raise the latching end from the receptacle assembly when the actuator is pulled in the pull direction.

In another embodiment, an electrical connector is provided. The electrical connector includes a housing and a latching assembly. The housing extends between a mating end and a terminating end. The mating end is configured to mate with a receptacle assembly. The latching assembly includes a latch and an actuator. The latch includes a plurality of ramps and a latching end. The latching end is configured to latch with a receptacle assembly. The actuator is movable in a push direction and in a pull direction. The actuator contacts a first one of the ramps to raise the latching end and unlatch the latching end from the receptacle assembly when the actuator is pushed in the push direction. The actuator contacts a second one of the ramps to raise the latching end and unlatch the latching end from the receptacle assembly when the actuator is pulled in the pull direction.

In another embodiment, another latching assembly for an electrical connector is provided. The latching assembly includes a housing, a latch, and an actuator. The housing extends along a longitudinal axis of the electrical connector and terminates at a mating end. The mating end is configured to be inserted into a receptacle assembly. The latch is connected to the housing. The latch includes a latching end configured to latch with the receptacle assembly. The actuator is coupled to the housing between the latch and the housing. The actuator is movable in a push direction, a pull direction, and a downward direction. The downward direction is orthogonal to the push and pull directions. The latching end unlatches from the receptacle assembly when the actuator is pushed in the push direction, when the actuator is pulled in the pull direction, and when the actuator is moved downward in the downward direction.

DETAILED DESCRIPTION OF THE INVENTION

Figure 1:
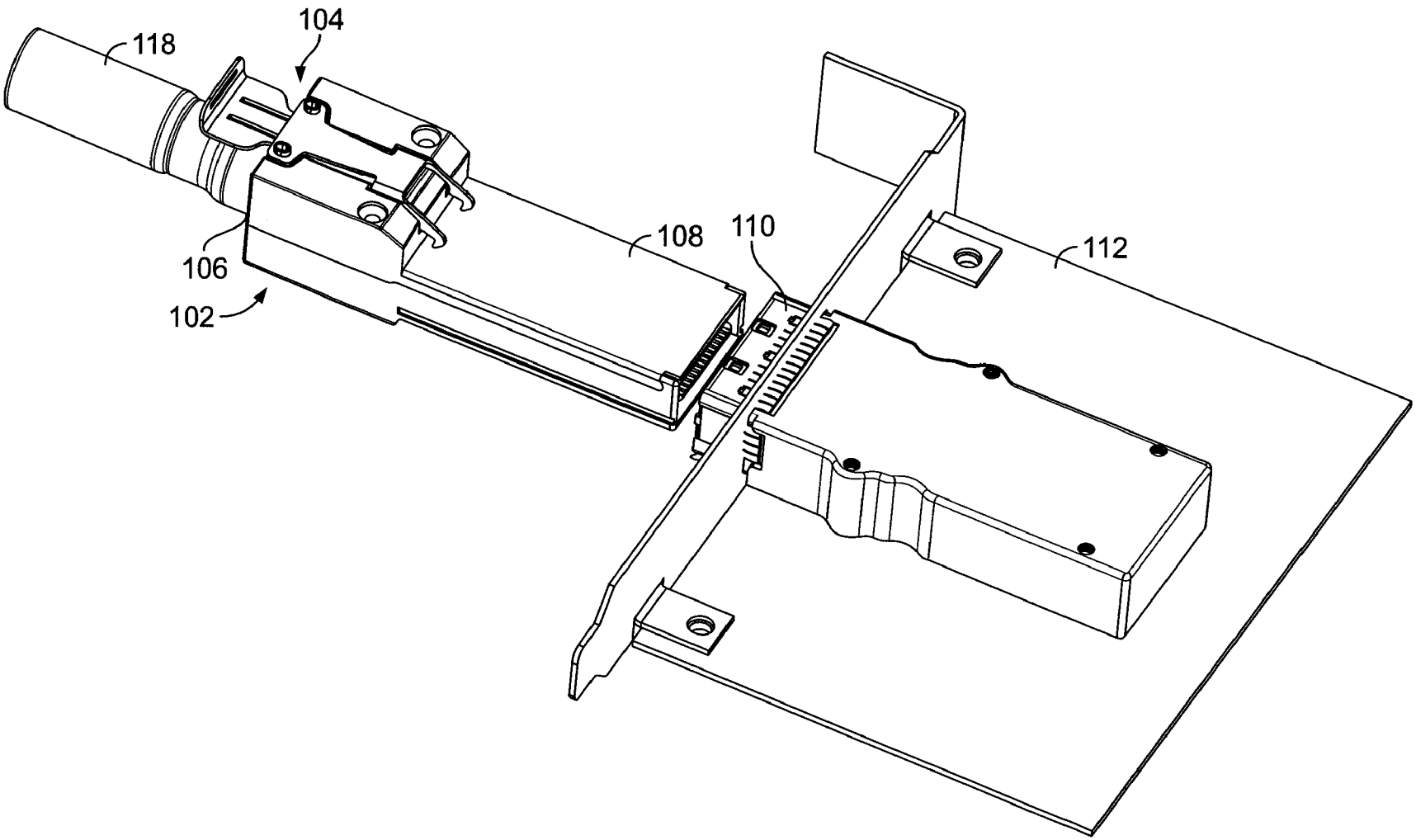
FIG. 1 is a perspective view of an electrical connector with a multi-directional latching assembly according to one embodiment.

FIG. 1 is a perspective view of an electrical connector 102 with a multi-directional latching assembly 104 according to one embodiment. The electrical connector 102 extends along a longitudinal axis between a terminating end 106 and a mating end 108. A cable 118 is terminated to the terminating end 106. The mating end 108 is configured to mate with and be inserted into a receptacle assembly 110. The receptacle assembly 110 is mounted on a printed circuit board ("PCB") 112. Once the mating end 108 is inserted into the receptacle assembly 110, the electrical connector 102 establishes an electrical connection between the cable 118 and the PCB 112.

The latching assembly 104 latches to the receptacle assembly 110 to secure the electrical connector 102 to the receptacle assembly 110 once the electrical connector 102 is inserted into the receptacle assembly 110. The latching assembly 104 may be unlatched from the receptacle assembly 110 in order that the mating end 108 of the electrical connector 102 may be removed from the receptacle assembly 110.

While FIG. 1 illustrates a mini-Serial Attached SCSI ("SAS") plug assembly, the latching assembly 104 can be used with a variety of electrical connectors 102. For example, the latching assembly 104 may be used in conjunction with a Small Form-Factor Pluggable ("SFP") electrical connector, a micro ribbon, or CHAMP, electrical connector, a channel max electrical connector, a Quad Small Form-Factor Pluggable ("QSFP") electrical connector, an SFP+ electrical connector, and the like. The mini-SAS plug assembly illustrated in FIG. 1 is thus merely illustrative and not restrictive.

Figure 2:
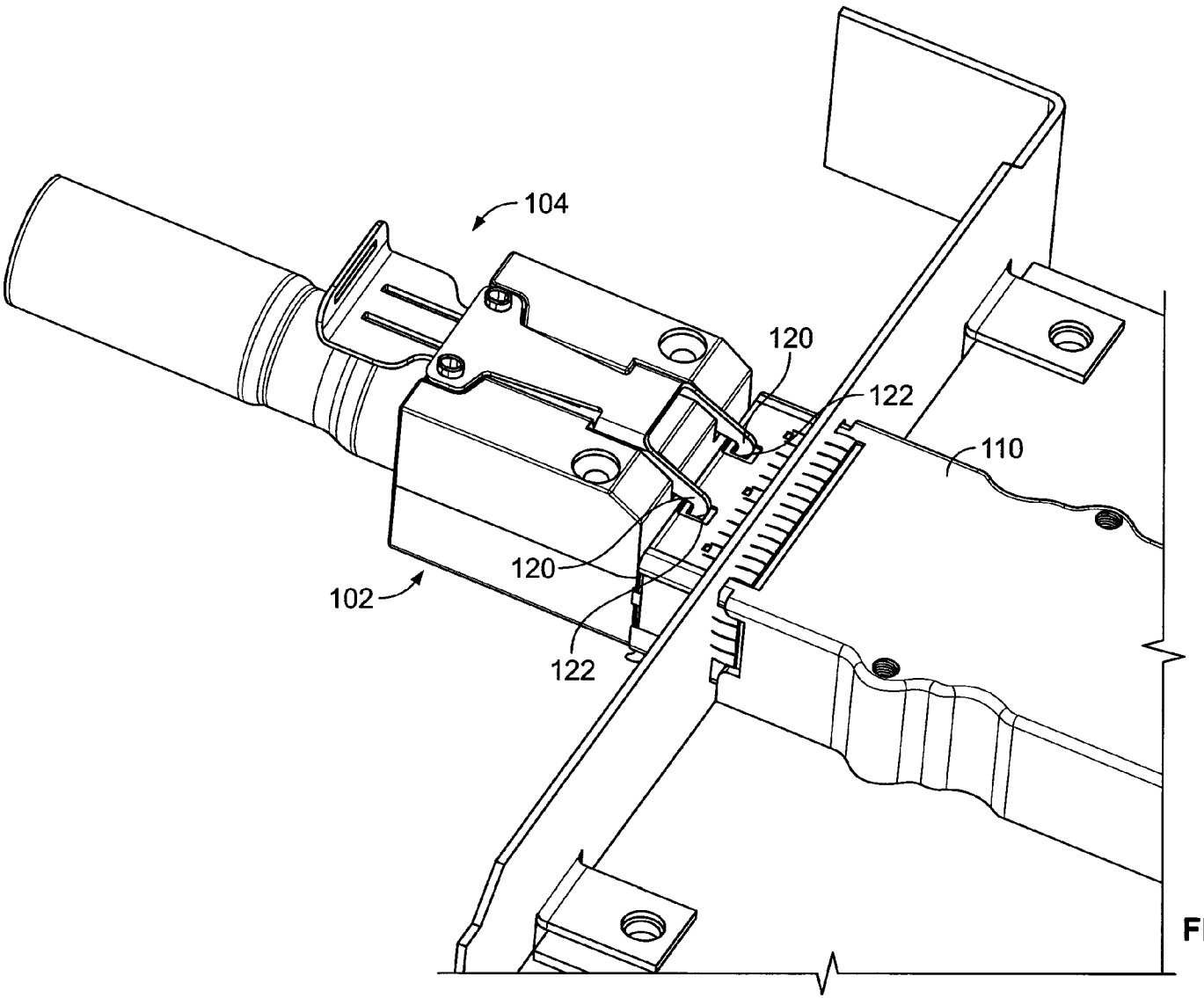
FIG. 2 is a perspective view of the electrical connector of FIG. 1 inserted into the receptacle assembly.

FIG. 2 is a perspective view of the electrical connector 102 of FIG. 1 mated with the receptacle assembly 110. FIG. 2 illustrates the mating end 108 of the electrical connector 102 (shown in FIG. 1) inserted into the receptacle assembly 110. Each of a pair of latching elements 120 is inserted into a corresponding hole 122 in the receptacle assembly 110. In the illustrated embodiment, the latching elements 120 represent hook elements. Once the latching elements 120 are inserted into the holes 122, the electrical connector 102 resists axial forces that would otherwise remove the electrical connector 120 from the receptacle assembly 110.

Figure 3:
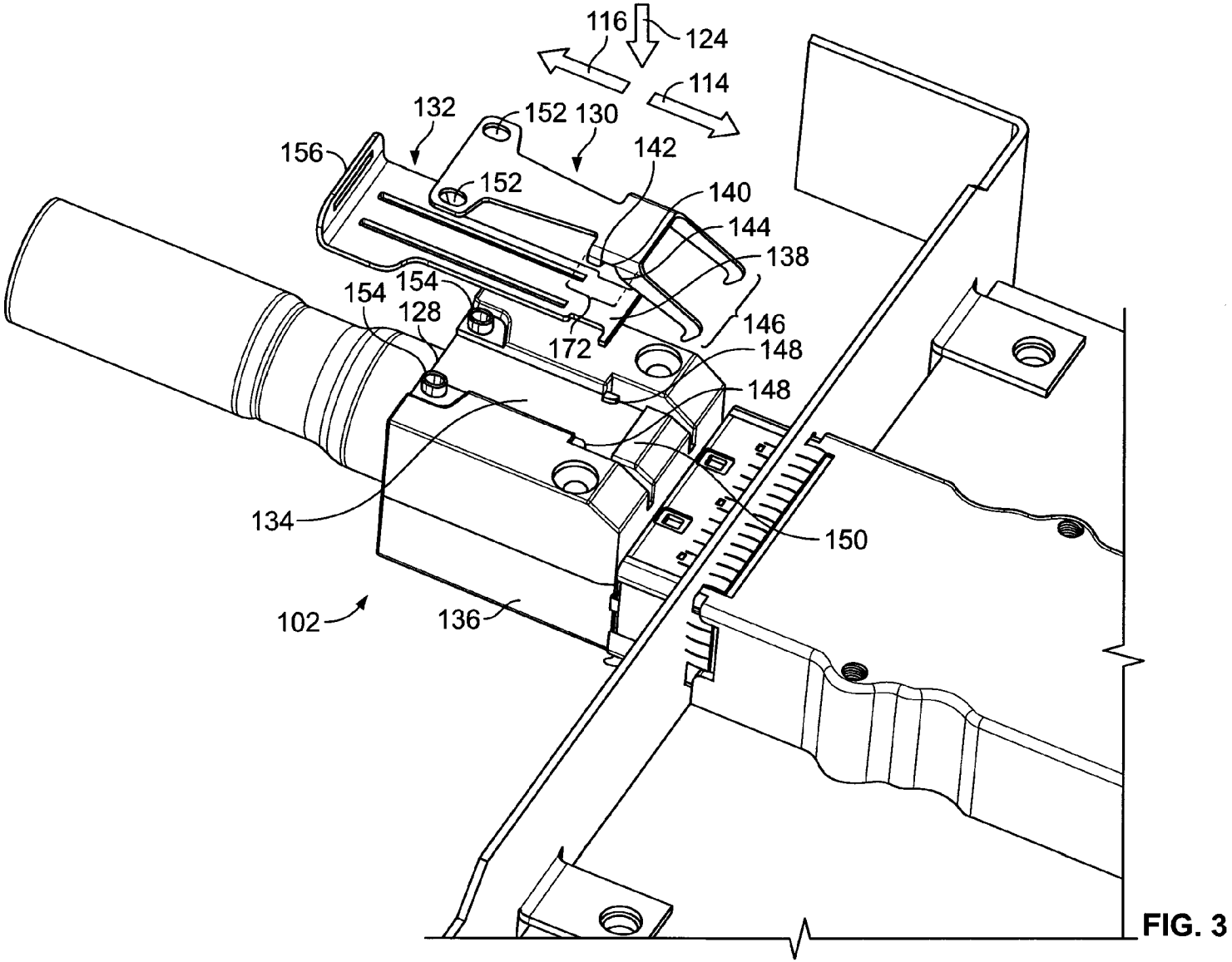
FIG. 3 is an exploded view of the electrical connector and the latching assembly of FIG. 1.

FIG. 3 is an exploded view of the electrical connector 102 and the latching assembly 104 of FIG. 1. The latching assembly 104 includes a latch 130 and an actuator 132. The actuator 132 is disposed between the latch 130 and a housing 136 of the electrical connector 102. A channel 134 in the housing 136 permits the actuator 132 to be pushed in a push direction 114 and pulled in a pull direction 116. The push and pull directions 114 and 116 are oriented parallel with the longitudinal axis of the electrical connector 102. Additionally, the push and pull directions 114 and 116 are linear and are diametrically opposed to one another.

The housing 136 includes an edge 128 proximate the terminating edge 106 of the electrical connector 102. The edge 128 provides a fulcrum about which the actuator 132 may pivot when the actuator 132 is pushed in a downward direction 124 proximate the actuator handle 156. The downward direction 124 is orthogonal to the longitudinal axis of the electrical connector 102 and to the push and pull directions 114 and 116.

A latch driving member 138 of the actuator 132 is moved in the push and pull directions 114 and 116 as the actuator 132 is pushed and pulled in the push and pull directions 114 and 116. The movement of the latch driving member 138 in both the push and pull directions 114 and 116 unlatches a latching end 146 of the latch 130 from the receptacle assembly 110 (shown in FIG. 1). Additionally, the latch driving member 138 of the actuator 132 is raised away from the housing 136 as the actuator 132 is pushed in the downward direction 124 proximate the actuator handle 156. The movement of the latch driving member 138 upwards away from the housing 136 unlatches the latching end 146 of the latch 130 from the receptacle assembly 110 (shown in FIG. 1).

Thus, moving the actuator 132 proximate the actuator handle 156 in the push direction 114, the pull direction 116 and the downward direction 124 raises the latching end 146 of the latch 130 so that the mating end 108 of the electrical connector 102 can be inserted into or removed from the receptacle assembly 110 (shown in FIG. 1). The pair of latching elements 120 are provided at the latching end 146.

A latch disengagement assembly 172 of the latch 130 includes a pair of oppositely sloped ramps 142 and 144 separated by a slot 140. Once assembled, the latch driving member 138 is located between the ramps 142 and 144 and between the slot 140 and the housing 136.

The latching assembly 104 is assembled so that the latch driving member 138 is in the channel 134 of the housing 102 between a pair of pull stops 148 and a push stop 150. In an exemplary embodiment, the pull and push stops 148 and 150 define protrusions that extend upwards from the channel 134 in the housing 102. The pull and push stops 148 and 150 limit the longitudinal movement of the latch driving member 138 (and thus the actuator 132) along the push and pull directions 114 and 116.

The latch 130 is secured to the housing 102 by inserting a pair of mounting holes 152 in the latch 130 over a pair of mounting pins 154 extending upwards from the housing 102. Once the latch 130 is secured to the housing 102 over the actuator 132, the actuator 132 may be pushed in the push direction 114 and pulled in the pull direction 116 by pushing and pulling on a handle 156 of the actuator 132.

Figure 4:
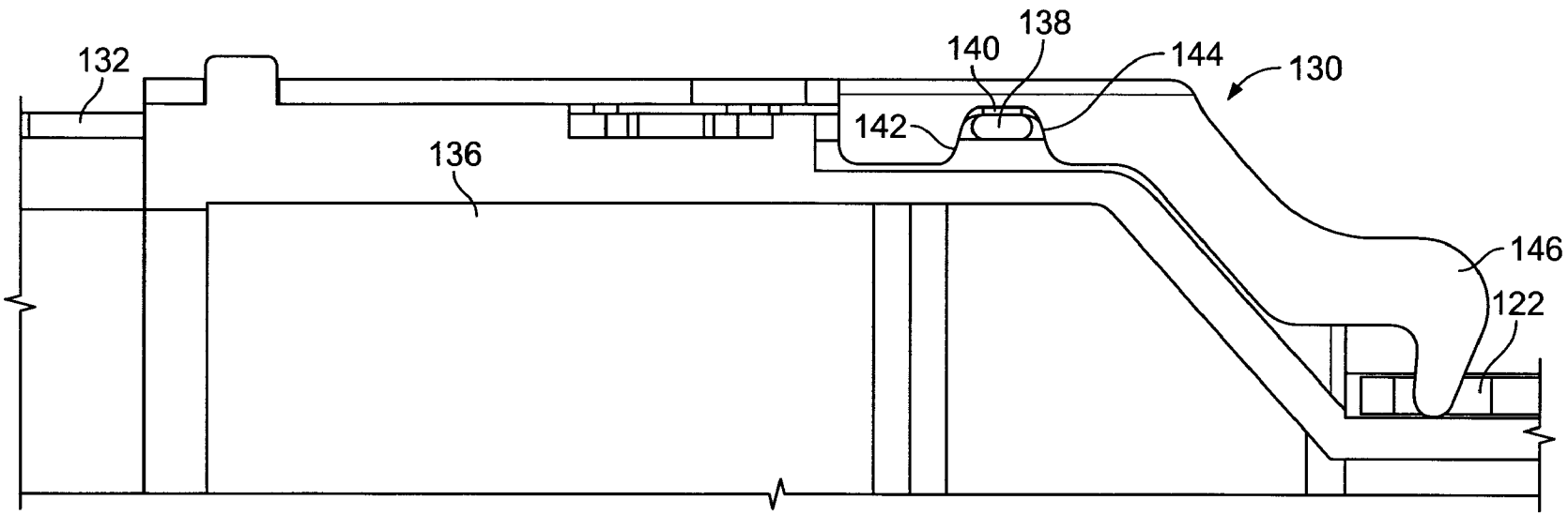
FIG. 4 is a cross-sectional view of the multi-directional latching assembly of FIG. 1 in a neutral position.

FIG. 4 is a cross-sectional view of the multi-directional latching assembly 104 of FIG. 1 in a neutral position. As described above, initially the latch driving member 138 of the actuator 132 is located between the housing 136 of the electrical connector 102 and the slot 140 of the latch 130, and between the two ramps 142 and 144 of the latch 130. In this position, the latching end 146 of the latch 130 is lowered and latches with the holes 122 of the receptacle assembly 110 (shown in FIG. 1). When the latching end 146 latches with the holes 122 of the receptacle assembly 110, the latching assembly 104 may resist axial forces and prevent the mating end 108 of the electrical connector 102 from being removed from the receptacle assembly 110.

Figure 5:
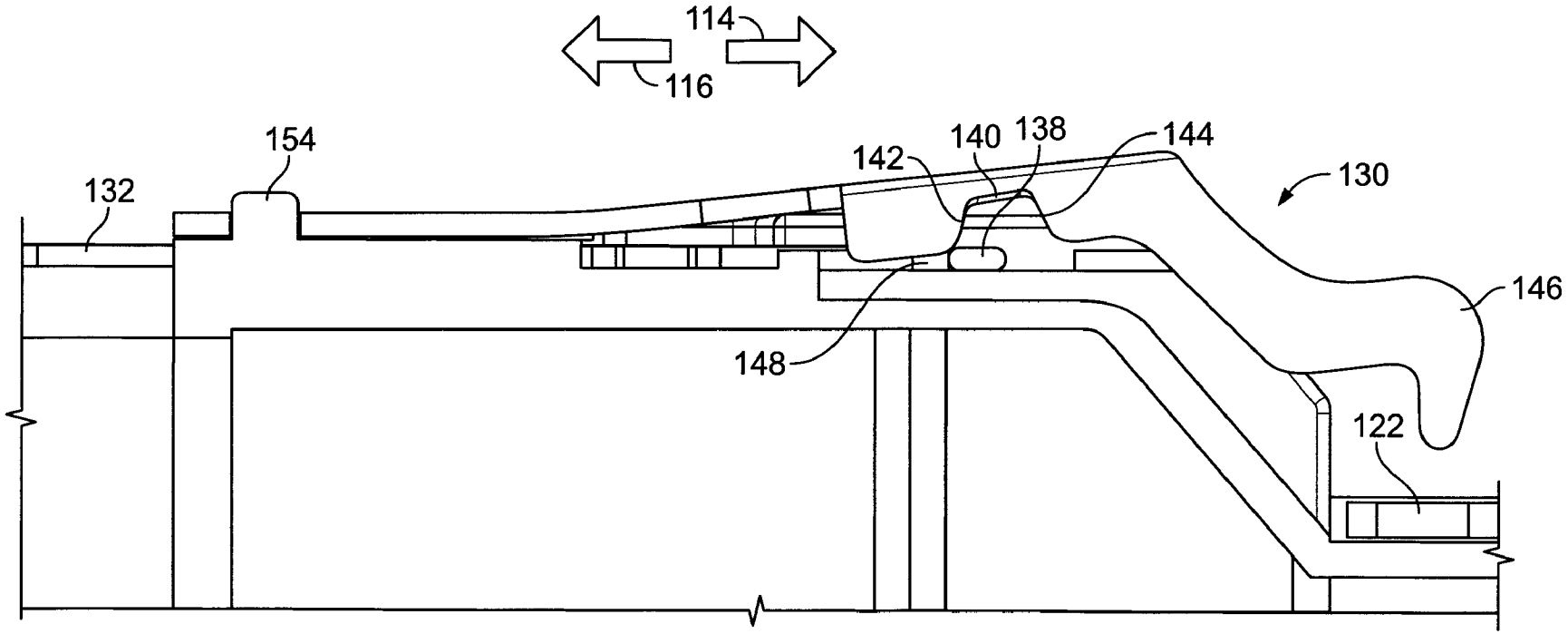
FIG. 5 is a cross-sectional view of the multi-directional latching assembly of FIG. 1 with the actuator pulled in the pull direction.

FIG. 5 is a cross-sectional view of the multi-directional latching assembly 102 of FIG. 1 with the actuator 132 pulled in the pull direction 116. As described above, the actuator 132 can be pulled in the pull direction 116 to raise the latching end 146 of the latch 130 and unlatch the latch 130 from the receptacle assembly 110 (shown in FIG. 1). In operation, the actuator 132 or actuator handle 156 (shown in FIG. 3) is pulled in the pull direction 116. When the actuator 132 is pulled in the pull direction 116, the latch driving member 138 also moves in the pull direction 116. The pull stops 148 may limit the distance that the latch driving member 138 (and thus the actuator 132) can move in the pull direction 116.

As the latch driving member 138 moves in the pull direction 116, the latch driving member 138 contacts and slides along the first ramp 142 of the latch 130. As the latch driving member 138 slides along the first ramp 142 of the latch 130, the first ramp 142 is raised upwards. As the first ramp 142 is raised upwards, the latch 130 flexes about the mounting pins 154 and the latching end 146 is raised. Once the latching end 146 is raised, the latching assembly 104 unlatches from the holes 122 in the receptacle assembly 110 (shown in FIG. 1), thereby allowing the mating end 108 of the electrical connector 102 to be withdrawn from the receptacle assembly 110.

When the actuator 132 is then released, the latch 130 tends to straighten and force the first ramp 142 downwards towards the latch driving member 138 of the actuator 132. The slope of the first ramp 142 may help move the latch driving member 138 (and thus the actuator 132) in the push direction 114 to a neutral position between the slot 140 and the housing 136, and between the two ramps 142 and 144 (shown in FIG. 4). When the latch driving member 138 returns to the neutral position, the latching end 146 of the latch 130 lowers and, if the mating end 108 is not withdrawn from the receptacle assembly 110, the latching end 146 latches with the holes 122 in the receptacle assembly 110 (shown in FIG. 1). In doing so, the latching assembly 104 latches with the receptacle assembly 110 when the actuator 132 is released after being pulled in the pull direction 116.

Figure 6:
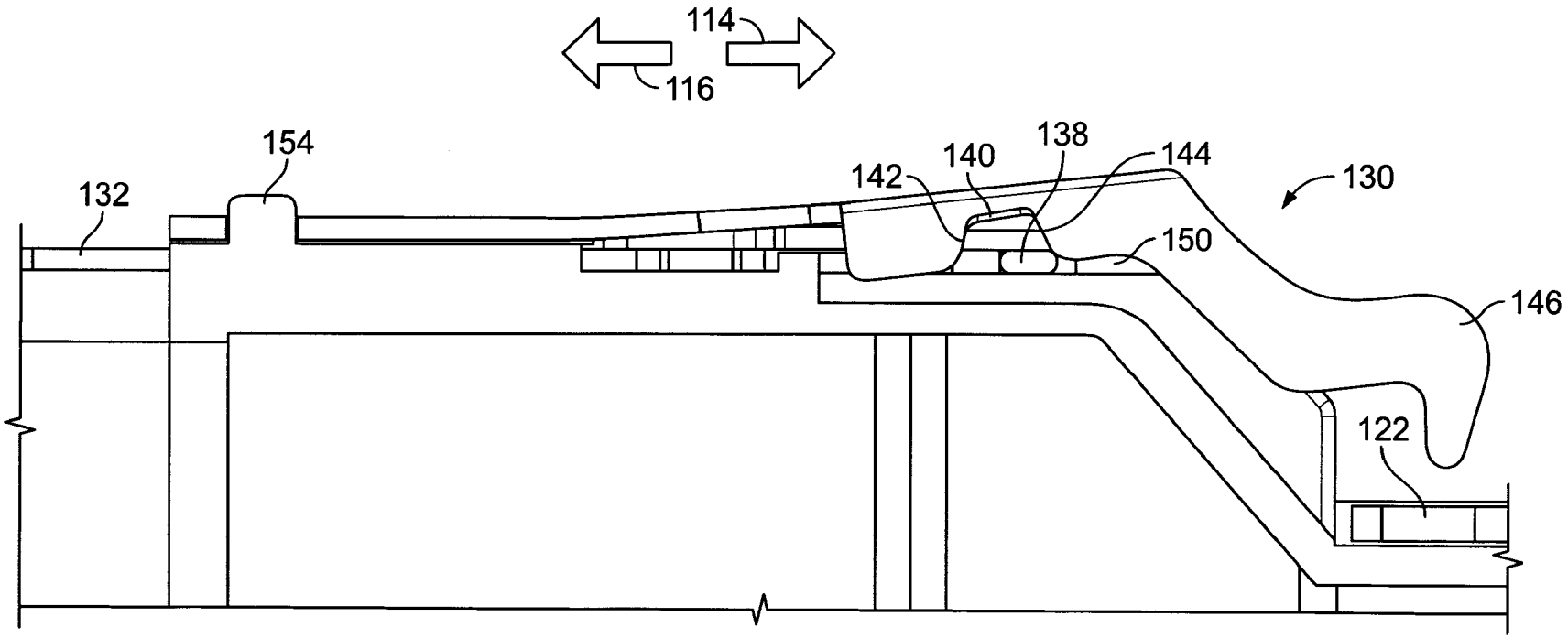
FIG. 6 is a cross-sectional view of the multi-directional latching assembly of FIG. 1 with the actuator pushed in the push direction.

FIG. 6 is a cross-sectional view of the multi-directional latching assembly 102 of FIG. 1 with the actuator 132 pushed in the push direction 114. As described above, the actuator 132 may be pushed in the push direction 114 to raise the latching end 146 of the latch 130 and unlatch the latch 130 from the receptacle assembly 110 (shown in FIG. 1). In operation, the actuator 132 or actuator handle 156 (shown in FIG. 3) is pushed in the push direction 114. Similar to pulling the actuator 132 in the pull direction 116, pushing the actuator 132 in the push direction 114 causes the latch driving member 138 to contact and slide along the second ramp 144 of the latch 130. As the latch driving member 138 slides along the second ramp 144, the second ramp 144 is raised upwards, thus raising the latching end 146 of the latch 130 out of the holes 122 in the receptacle 110 (shown in FIG. 1). Once the latching end 146 is raised out of the holes 122, the latching assembly 104 is unlatched from the receptacle 110.

Similar to the pull stops 148, the push stop 150 may limit the distance that the latch driving member 138 (and thus the actuator 132) can move in the push direction 114.

Similar to releasing the actuator 132 after movement in the pull direction 116, releasing the actuator 132 after movement in the push direction 114 allows the latching end 146 of the latch 130 to lower and latch with the holes 122 in the receptacle 110. Once the actuator 132 is then released, the latch 130 straightens and forces the second ramp 144 downward. As the second ramp 144 is forced downward, the slope of the second ramp 144 moves the latch driving member 138 (and thus the actuator 132) in the pull direction 116 to the neutral position between the slot 140 and the housing 136, and between the two ramps 142 and 144 (shown in FIG. 4).

Figure 9:
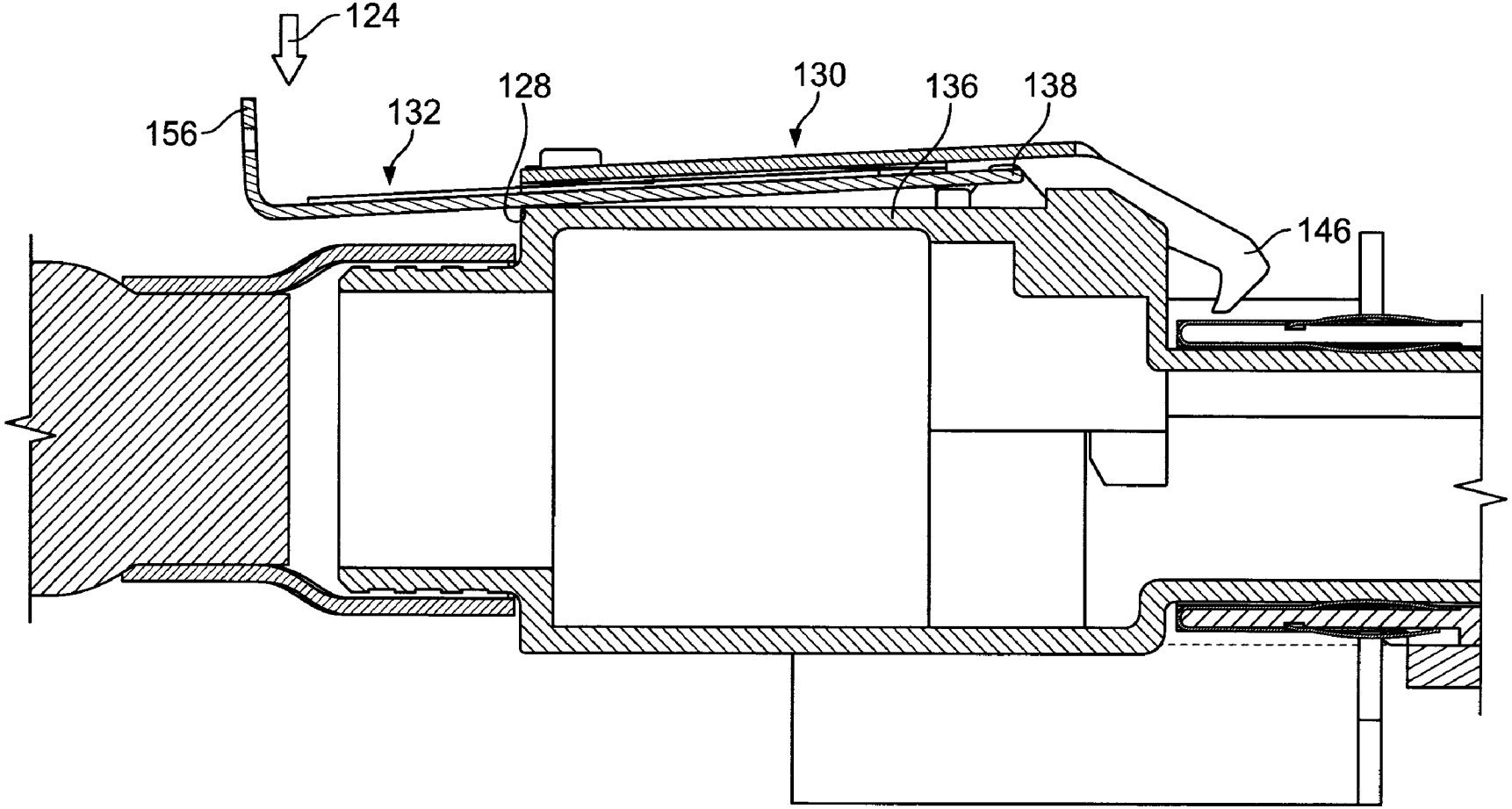
FIG. 9 is a cross-sectional view of the multi-directional latching assembly of FIG. 1 with the actuator pushed in the downward direction proximate the actuator handle.

FIG. 9 is a cross-sectional view of the multi-directional latching assembly 102 of FIG. 1 with the actuator 132 pushed in the downward direction 124 proximate the actuator handle 156. As described above, the actuator 132 may be pushed in the downward direction 124 proximate or at the actuator handle 156 to raise the latching end 146 of the latch 130 and unlatch the latch 130 from the receptacle assembly 110 (shown in FIG. 1). In operation, the actuator handle 156 or the actuator 132 proximate the actuator handle 156 is pushed in the downward direction 124. As the actuator 132 proximate the actuator handle 156 moves in the downward direction 124, the actuator 132 contacts the edge 128 of the housing 136. As the actuator 132 proximate the actuator handle 156 continues to move in the downward direction 124, the edge 128 of the housing 136 acts as a fulcrum about which the actuator 132 pivots. As the actuator 132 pivots about the edge 128 of the housing 136, the latch driving member 138 is raised upwards, thus raising the latching end 146 of the latch 130 out of the holes 122 in the receptacle 110 (shown in FIG. 1). Once the latching end 146 is raised out of the holes 122, the latching assembly 104 is unlatched from the receptacle 110.

Also similar to releasing the actuator 132 after pulling the actuator 132 in the pull direction 116 and pushing the actuator 132 in the push direction 114, the latching end 146 of the latch 130 lowers and latches with the holes 122 in the receptacle 110 after the actuator 132 is released after being moved in the downward direction 124. After moving and releasing the actuator 132 proximate the actuator handle 132 in the downward direction 124, the latch 130 straightens and forces the latching end 146 downward.

Figure 7:
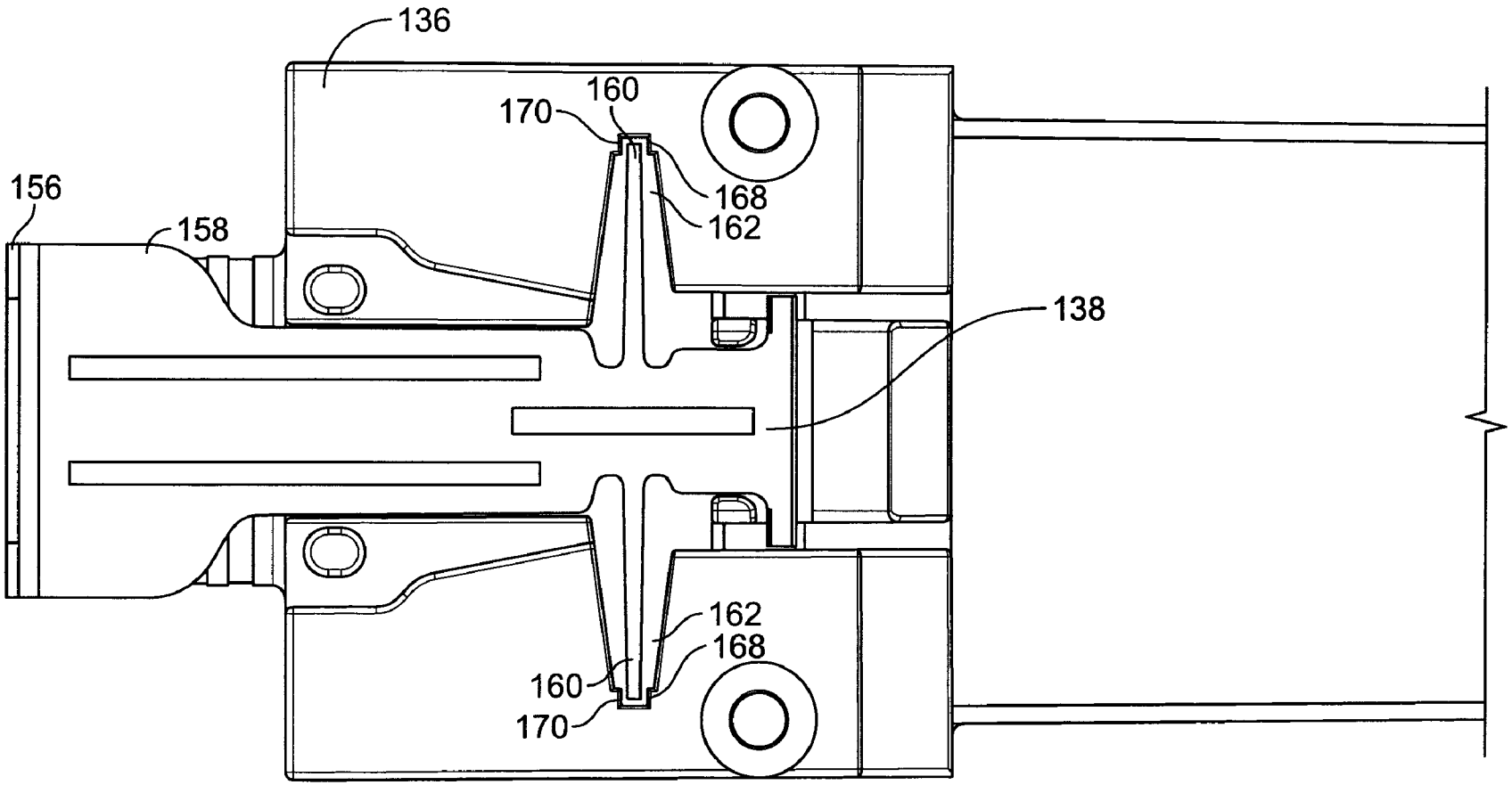
FIG. 7 is a plan view of an alternative embodiment of the electrical connector and the multi-directional latching assembly of FIG. 1 with the latch removed.

FIG. 7 is a plan view of an alternative embodiment of the electrical connector 102 and the multi-directional latching assembly 104 of FIG. 1 with the latch 130 removed. The actuator 158 illustrated in FIG. 7 is similar to the actuator 132 with the addition of a pair of centering beams 160. The centering beams 160 extend laterally from opposing sides of the actuator 158. The centering beams 160 are located in lateral extensions 162 of the channel 134. The lateral extensions 162 include recesses in the housing 136 that extend the channel 134 in opposing directions. The centering beams 160 and the lateral extensions 162 of the channel 134 assist in returning the actuator 158 to the neutral position (shown in FIG. 4) after the actuator 158 has been pushed in the push direction 114 and after the actuator 158 has been pulled in the pull direction 116 and then released. That is, the centering beams 160 and the lateral extensions 162 assist in returning the latch driving member 138 of the actuator 158 to a position between the housing 136 and the slot 140, and between the first and second ramps 142 and 144 of the latch 130 (shown in FIG. 4). The centering beams 160 may be integrally formed with the actuator 158 or may be coupled to the actuator 158.

In operation, the centering beams 160 contact a first side 168 of the lateral extensions 162 of the channel 134 when the actuator 158 is pushed in the push direction 114. As the actuator 158 is pushed in the push direction 114 to raise the latching end 146 of the latch 130 (shown in FIG. 3), the centering beams 160 flex against the first side 168 of the lateral extensions 162. When the actuator 158 is released, the centering beams 160 straighten and force the actuator 158 towards the pull direction 116. The centering beams 160 continue to force the actuator 158 towards the pull direction 116 until the actuator 158 has returned to the neutral position (shown in FIG. 4). In doing so, the centering beams 160 cause the latching end 146 of the latch 130 to lower and latch the receptacle assembly 110 once the actuator 158 is released after being pushed in the push direction 114.

Conversely, as the actuator 158 is pulled in the pull direction 116, the centering beams 160 flex against a second side 170 of the lateral extensions 162. When the actuator 158 is released, the centering beams 160 straighten and force the actuator 158 back towards the push direction 114 until the actuator 158 has returned to the neutral position (shown in FIG. 4). Thus, the centering beams 160 cause the latching end 146 of the latch 130 to lower and latch with the receptacle assembly 110 once the actuator 158 is released after being pulled in the pull direction 116.

Figure 8:
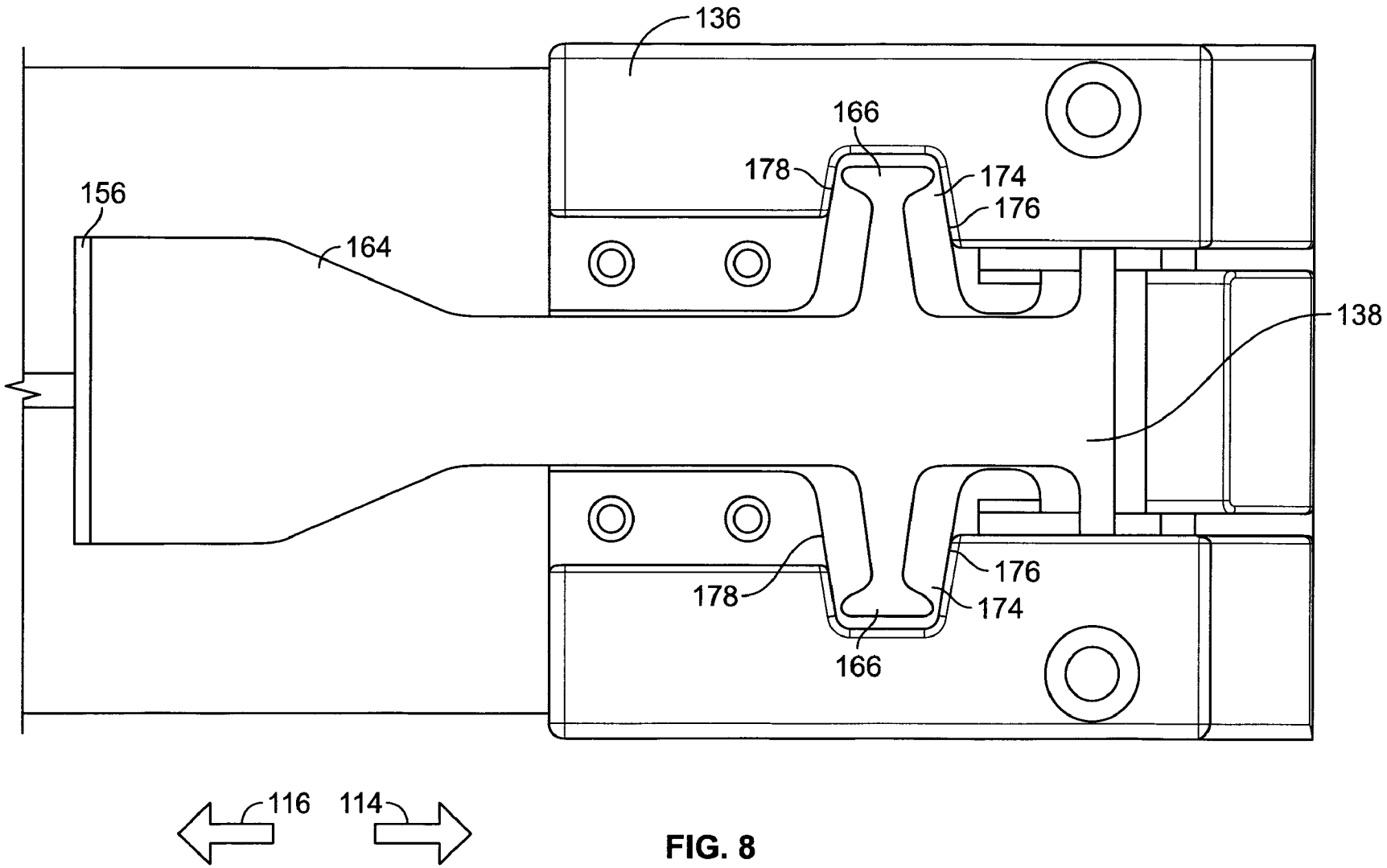
FIG. 8 is a plan view of another embodiment of the electrical connector and the multi-directional latching assembly of FIG. 1 with the latch removed.

FIG. 8 is a plan view of another embodiment of the electrical connector 102 and the multi-directional latching assembly 104 of FIG. 1 with the latch 130 removed. Actuator 164 illustrated in FIG. 8 is similar to the actuator 158. The centering beams 166 of the actuator 164 are "T" shaped. The centering beams 166 are located in lateral extensions 174 of the channel 134. The lateral extensions 174 include recesses in the housing 136 that extend the channel 134 in opposing directions.

The T-shape of the centering beams 166 reduces the amount of travel required by the actuator 164 in the push direction 114 before the centering beams 166 contact the first side 176 of the lateral extensions 162 of the channel 134. Additionally, the centering beams 166 reduce the amount of travel required by the actuator 164 in the pull direction 116 before the centering beams 166 contact the second side 178 of the lateral extensions 162. By reducing the amount of travel required by the actuator 164 before the centering beams 166 contact the first or second sides 176, 178 of the lateral extensions 174, the centering beams 166 may create a greater force to return the actuator 164 to the neutral position (shown in FIG. 4) when the actuator 164 is pushed in the push direction 114 and pulled in the pull direction 116.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A latching assembly for an electrical connector, the electrical connector extending along a longitudinal axis between a terminating end and a mating end, the latching assembly comprising:

a latch having a latching end configured to latch with a receptacle assembly; and an actuator movable in both a push direction and a pull direction along the longitudinal axis of the electrical connector, the actuator raising the latching end to unlatch the latch from the receptacle assembly when the actuator is pushed in the push direction and when the actuator is pulled in the pull direction.

2. The latching assembly according to claim 1, wherein the push and pull directions are diametrically opposed to one another.

3. The latching assembly according to claim 1, wherein the actuator is moveable in a downward direction that is orthogonal to the push and pull directions, the actuator raising the latching end to unlatch the latch from the receptacle assembly when the actuator is moved in the downward direction.

4. The latching assembly according to claim 1, wherein the latch includes a pair of oppositely sloped ramps, the actuator sliding along a first one of the ramps to raise the latching end and unlatch the latching end from the receptacle assembly when the actuator is pushed in the push direction, the actuator sliding along a second one of the ramps to raise the latching end and unlatch the latching end from the receptacle assembly when the actuator is pulled in the pull direction.

5. The latching assembly according to claim 1, further including a housing of the electrical connector, the housing having a channel, the actuator moving in the push and pull directions along the channel.

6. The latching assembly according to claim 5, wherein the channel includes a push stop that limits the movement of the actuator in the push direction.

7. The latching assembly according to claim 5, wherein the channel includes at least one pull stop that limits the movement of the actuator in the pull direction.

8. The latching assembly according to claim 1, wherein the actuator includes a pair of centering beams extending laterally from opposing sides of the actuator, the beams causing the latching end to latch with the receptacle assembly after the actuator is pushed in the push direction and then released, and after the actuator is pulled in the pull direction and then released.

9. An electrical connector comprising:

a housing extending between mating and terminating ends, the mating end configured to mate with a receptacle assembly; and a latching assembly coupled to the housing, the latching assembly comprising:

a latch having a plurality of ramps and a latching end, the latching end configured to latch with a receptacle assembly; and an actuator movable in a push direction and in a pull direction, wherein the actuator contacts a first one of the ramps to raise the latching end and unlatch from the latching end from the receptacle assembly when the actuator is pushed in the push direction, the actuator contacting a second one of the ramps to raise the latching end and unlatch from the latching end from the receptacle assembly when the actuator is pulled in the pull direction.

10. The electrical connector of claim 9, wherein the actuator is moveable in a downward direction proximate an actuator handle, the downward direction being orthogonal to the push and pull directions, the actuator raising the latching end to unlatch from the receptacle assembly when the actuator is moved in the downward direction.

11. The electrical connector of claim 9, wherein the housing comprises a channel in which the actuator is pushed in the push direction and pulled in the pull direction, the housing including a plurality of stops configured to limit a distance that the actuator is pushed in the push direction and pulled in the pull direction.

12. The electrical connector of claim 9, wherein the actuator includes a latch driving member, the latch driving member sliding along the first ramp to raise the latching end when the actuator is pushed in the push direction and sliding along the second ramp to raise the latching end when the actuator is pulled in the pull direction.

13. The electrical connector of claim 12, wherein the latch includes a slot between the first and second ramps, the latching end of the latch-being lowered to latch with the receptacle assembly when the latch driving member contacts the slot.

14. The electrical connector according to claim 9, wherein the actuator includes a pair of centering beams extending laterally from opposing sides of the actuator, the beams causing the latching end to latch with the receptacle assembly after the actuator is pushed in the push direction and then released, and after the actuator is pulled in the pull direction and then released.

15. A latching assembly for an electrical connector, the latching assembly comprising:

a latch connected to a housing of the electrical connector, the latch having a latching end configured to latch with the receptacle assembly; and an actuator coupled to the housing between the latch and the housing, the actuator being movable in a push direction, a pull direction, and a downward direction, the downward direction being orthogonal to the push and pull directions, wherein the latching end unlatches from the receptacle assembly when the actuator is pushed in the push direction, when the actuator is pulled in the pull direction, and when the actuator is moved in the downward direction.

16. The latching assembly according to claim 15, wherein the latch includes a plurality of oppositely sloped ramps, the actuator engaging a first one of the ramps when the actuator is pushed in the push direction and engaging a second one of the ramps when the actuator is pulled in the pull direction.

17. The latching assembly according to claim 16, wherein the actuator includes a latch driving member, the latch driving member sliding along the first ramp when the actuator is pushed in the push direction to raise the latching end, the latch driving member sliding along the second ramp when the actuator is pulled in the pull direction to raise the latching end, the latching end disengaging the receptacle assembly when the latching end is raised.

18. The latching assembly according to claim 15, wherein the push and pull directions are diametrically opposed to one another along a longitudinal axis of the housing.

19. The latching assembly according to claim 15, wherein the latching end latches with the receptacle assembly after the actuator is pushed in the push direction and released and after the actuator is pulled in the pull direction and released.

20. The latching assembly according to claim 15, wherein the actuator includes a plurality of centering beams extending laterally from opposing sides of the actuator, the beams configured to move the actuator in the push direction after the actuator is pulled in the pull direction and released, the beams configured to move the actuator in the pull direction after the actuator is pushed in the push direction and released.

* * * * *